United States Patent [19]

Lischka et al.

[11] Patent Number: 4,943,317

[45] Date of Patent: Jul. 24, 1990

[54] AGENT FOR DESULPHURIZING IRON MELTS, A PROCESS FOR THE PRODUCTION THEREOF AND A PROCESS FOR DESULPHURIZING IRON MELTS WITH THE USE OF SAID AGENT

[75] Inventors: Helmut Lischka, Trostberg; Werner Gmöhling, Hufschlag; Gerd Hieber, Seeon, all of Fed. Rep. of Germany

[73] Assignee: SKW Trostberg Aktiengesellschaft, Trostberg, Fed. Rep. of Germany

[21] Appl. No.: 407,422

[22] Filed: Sep. 14, 1989

[30] Foreign Application Priority Data

Sep. 20, 1988 [DE] Fed. Rep. of Germany ..... 3831831

[51] Int. Cl.[5] ..... C21C 7/02

[52] U.S. Cl. ..... 75/312; 75/566; 75/773

[58] Field of Search ..... 75/53, 58

[56] References Cited

U.S. PATENT DOCUMENTS 3,998,625 12/1976 Koros ..... 75/58

4,541,867 9/1985 Neelameggham ..... 75/58

*Primary Examiner*—Peter D. Rosenberg

*Attorney, Agent, or Firm*—Felfe & Lynch

[57] ABSTRACT

The present invention provides an agent for desulphurizing iron containing calcium carbide and a metallic component, wherein the calcium carbide and the metallic component are present in such a form that the bulk densities and grain sizes thereof lie in the same range.

The present invention also provides a process for producing this agent, as well as a process for desulphurizing iron using this agent.

14 Claims, 3 Drawing Sheets

Figure 1:
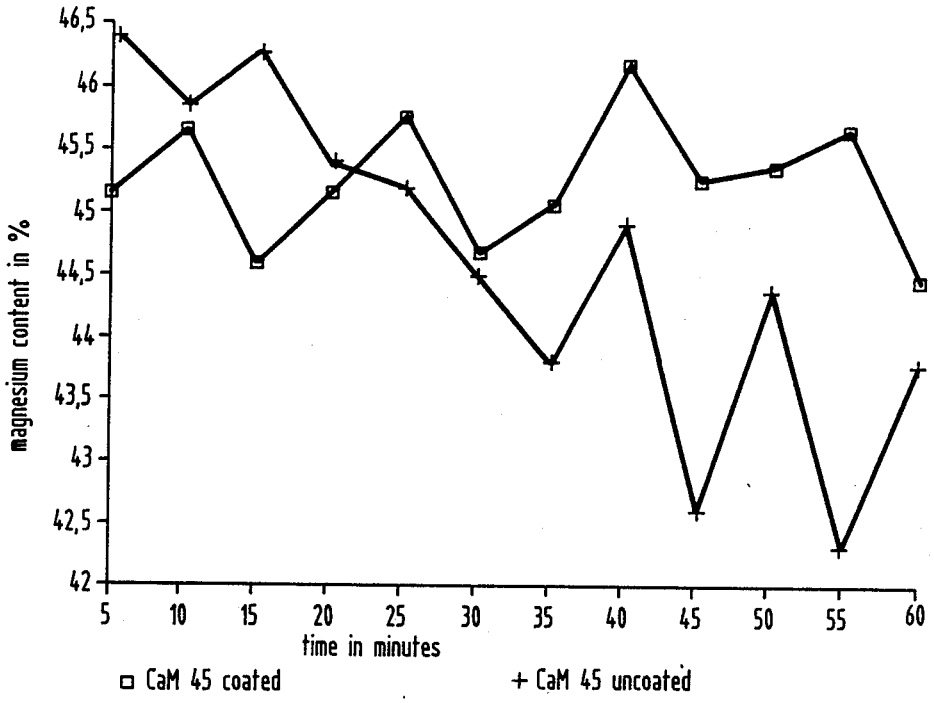

AGENT FOR DESULPHURIZING IRON MELTS, A PROCESS FOR THE PRODUCTION THEREOF AND A PROCESS FOR DESULPHURIZING IRON MELTS WITH THE USE OF SAID AGENT

FIELD OF THE INVENTION

The present concerned with an agent for desulphurising iron melts, a process for the production thereof, as well as a process for desulphurising iron melts. The agent contains calcium carbide and a metallic component.

BACKGROUND OF THE INVENTION AND THE PRIOR ART

The desulphurising of iron melts outside of a blast furnace by injection metallic process is a well established process in the production of steel. For the reduction of the sulphur content in crude iron, in practice two processes have proved to be especially useful, namely, desulphurisation in a torpedo ladle and treatment of the iron melts in a charging ladle in the steelworks. According to both processes, desulphurisation is carried out by injection metallurgically, i.e. the desulphurisation mixture is blown into the crude iron melt through an immersion lance using a current of an inert gas.

In practice, for carrying out this process, desulphurising mixtures of calcium carbide and magnesium, possibly with further additive, for example gas developing carbon, alkaline earth metal carbonates, calcium oxide, calcium fluoride or calcium cyanamide, have proved to be advantageous. By way of example, reference is made to the following publications: German Offenlegungsschriften Nos. 25 31 047; 26 50 113; 27 08 424; 27 41 588; 35 44 562 and Stahl und Eisen, 105, No. 11, 627–630/1985.

A disadvantage of some of these processes is the use of a mixture of materials which is not mixturestable. Thus, magnesium, which makes possible a rapid and precise desulphurisation of crude iron, cannot be dosed in its amount with the necessary exactitude. Insofar as the above-mentioned processes provide for a separate addition of the magnesium to the desulphurising mixture in the form of co-injection, a relatively great expenditure for apparatus is needed in order to be able to dose the components exactly. In order in the case of co-injection to be able to dose precisely, magnesium is frequently used in admixture with slag, with aluminum shavings or other oxidic compounds. These agents also separate and, therefore, do not solve the problem.

For the above-mentioned reasons, attempts have not been lacking to produce magnesium-containing desulphurisation agents in the form of pellets, filled wires or by coating which are to impart to these agents a simplified handling and an increased process effectiveness. Such a desulphurisation agent is described, for example, in German Auslegeschrift No. 12 99 670. It has a multilayer construction and, besides magnesium and calcium carbide, can contain further desulphurising components. However, the dimensions and compositions of the pressed bodies described in this publication are unsuitable for use in a co-injection process.

Furthermore, from German Offenlegungsschrift No. 24 22 072 is known a desulphurisation agent based on calcium carbide which is coated with magnesium metal. According to the process of this publication, the coating of the granulated calcium carbide takes place by deposition of magnesium vapour. From the actual economic point of view, the process is too laborious and too cost-intensive in order to be able to use this product for co-injection, even in the case of possible technical suitability.

The desulphurisation by means of a calcium carbidemagnesium mixture in the form of a filled wire or in the form of rods, as can be gathered from German Offenlegungsschrift No. 27 38 379, cannot be used in the co-injection process for obvious reasons.

Finally, U.S. Pat. No. 4,541,867 discloses the production of a granular agent coated with carbon which can be used as an additive for steel baths and for the desulphurisation thereof. The agent can, inter alia, consist of magnesium and calcium carbide. The coating is produced by mixing the components of the agent with a polymerisable oil, thermal polymerisation thereof and subsequent partial thermal decomposition thereof. This production process also requires a relatively high expenditure for apparatus and a high use of energy.

In general, it is also to be pointed out that because of the high magnesium vapor pressure at the temperatures of the iron melt, the introduction of the magnesium into the melts gives rise to problems. Therefore, a good dosability of the magnesium component is important for the process but has not been satisfactorily fulfilled by the desulphurisation agents at present known. Especially when magnesium is blown in without the co-injection component calcium carbide, it results in the ejection of iron and in blockage of the lances used. A disadvantage of the general nature of known mixtures is the fact that they have a content of filling materials of from 20 to 34% by weight which do not participate in the desulphurisation. A further disadvantage of known mixtures of magnesium with filling materials, such as aluminum, aluminum oxide or ball mill dust, is the fact that these separate relatively quickly so that the proportion of magnesium is initially high but thereafter decreases. Because of this inhomogeneity, a greater use of material is necessary but with a poorer action.

OBJECTS OF THE INVENTION

Therefore, there is a need to provide a freeflowing, low slag and inexpensive agent which contains calcium carbide and a metallic component which is suitable for injection in the desulphurising of iron melts and which does not suffer from the abovementioned disadvantages.

DESCRIPTION OF THE INVENTION

Thus, according to the present invention, there is provided an agent for desulphurising iron which contains calcium carbide and a metallic component, wherein the calcium carbide and the metallic component are present in such a form that the bulk densities and grain sizes thereof lie in the same range.

Thus, according to the present invention, there is provided an agent for desulphurising iron melts which consists of two components which do not separate even in the case of standing for a comparatively long time, in the case of transport, in the case of comparatively long storage in a silo or in the case of pneumatic conveying and which, therefore can be dosed very well. In this way, the rate of blowing in of the metallic component can be controlled very well which is of fundamental importance for a precise desulphurisation with the result of an optimum cost-use effect. The agent according to the present invention can be used alone for the desulphurising. However, it is just as suitable for co-injection in combination with other desulphurising agents such as are described, for example, in European patent application No. 0 226 994 Al.

The agent according to the present invention consists essentially of two components, namely, calcium carbide and a metallic component. The metallic component can be calcium, magnesium or an alloy thereof. For the desulphurising agent, it is preferred to use magnesium metal. The particular proportion of the two components in the mixture is itself not critical and can be varied within wide ranges. Usually, the agent according to the present invention contains 10 to 90% by weight of calcium carbide preferably 20 to 80% by weight thereof and 90 to 10% by weight and preferably 80 to 20% by weight of the metallic component.

The two components which are essential according to the present invention are used in such a form that the bulk densities and grain sizes thereof lie in the same range. As a rule, the bulk density of the metallic component is adapted to the bulk density of the calcium carbide. Therefore, the bulk density is preferably adjusted to a range of from 0.7 to 1.0 g./cm$^3$ and especially preferably to 0.8 to 0.9 g./cm$^3$. The production of the two components with the appropriate bulk density takes place according to known methods.

The grain size of the two components is also adjusted to the same range by appropriate grinding. The grain size preferably lies in the range of from 0.1 to 3 mm. and especially preferably of from 0.3 to 1 mm.

For use for the desulphurisation of iron melts, the two components are mixed with one another, fluidized and then blown in through a lance. Due to the use of particles of the same size and of the same bulk density, a very homogeneous mixture can be produced which does not separate even after a comparatively long period of time. In a preferred embodiment of the present invention, the particles of the two components are coated. For the coating, an adhesive is applied to the particles and subsequently a finely divided dust. The coating amounts to 1 to 10% by weight, referred to the weight of the whole grain. As adhesive, there is used an oily liquid which adheres to the particles. For this purpose, there can be used, for example, a vegetable oil, a silicone oil and/or a mineral oil. In a second step, a finely divided dust is then applied. For the coating, there can be used, for example, silicate dusts or oxidic dusts such as are obtained, for example, in the aluminum industry. Examples therefore include finely divided silicic acid, bentonite and/or furnace filter dust from the production of calcium-silicon and/or ferrosilicon and/or other ferrous alloys, as well as other oxidic compounds, for example calcium aluminate.

Because of the properties of this preferred agent, the separating is still lower and the dosability is thus possible with greater precision. A typical and especially preferred composition contains 45% by weight of magnesium, 45% by weight of technical calcium carbide, the calcium carbide content of which is usually from 65 to 80% by weight, 0.5% by weight of an oil and 9.5% by weight of a coating material.

The coating of the agent according to the present invention is especially advantageous. This measure brings about the production of surfaces of the same material on the two components calcium carbide and metallic component. A surface of the same material, for example in the form of a silicic acid-containing coating, imparts to the agent not only excellent flow properties but also especially counters a separation of the components so that in the case of transport, in the case of handling and silo storage, the homogeneity of the agent is fully maintained.

As adhesives, there are used highly viscous oils, especially those of vegetable origin, but also silicone oils and/or mineral oils. In order to avoid a decomposition of the carbide, oils are preferred which are anhydrous or have a low water content, the proportion by weight thereof in the agent being from 0.1 to 1% by weight. They form the basis for a securely adhering, unbroken coating which imparts the desired properties to the agent. A further advantage of this preferred embodiment is that the oil also binds carbide and magnesium fines and, in this way, makes the desulphurising agent dust-free. Furthermore, the sensitivity of the carbide component toward moisture is reduced.

On to the adhesive layer is applied a layer of finely divided dust. For this purpose, there are used dusts with a grain size of less than 10 μm. The proportion of the finely divided dust in the desulphurising agent is from 2 to 10% by weight.

The production of the agent according to the present invention takes place by a simple mixing of technical calcium carbide and of the metallic component in the desired granulation under an inert gas atmosphere. If coated particles are used for the agent according to the present invention, then, after grinding the two components to the desired particle size, the surface of the particles is wetted with the oil and the finely divided dust subsequently applied thereto. The process can be carried out not only batchwise in a drum, trough or truncated cone mixer but also continuously, for example in a screw mixer. Although the agent consisting of coated particles is less inflammable than finely divided magnesium, nevertheless the mixing procedure advantageously also takes place under an atmosphere of dry inert gas in order to exclude moisture during the production in which the magnesium and calcium carbide are present in free form and, at the same time, to exclude the danger of a dust explosion due to finely divided magnesium which can possibly be present.

The agent according to the present invention can be blown into metal melts with argon or nitrogen as carrier medium without any additives or dilution agents. In the same way, it can also be used as co-injection partner with other desulphurising agents. Without having to fear an ejection of iron, the agent either alone or together with another desulphurising mixture can be blown in without any problems with a rate of 10 to 100 kg./min., the preferred rate of blowing in being 20 to 40 kg./min. The high rate of blowing in makes possible a substantial shortening of the blowing times and, futhermore, the degree of filling of the pig iron ladle can be increased due to the quiet blowing behaviour of the agent.

The productivity and the economy of the desulphurisation process is considerably improved by the use of the agent according to the present invention.

Thus, according to the present invention, an agent is made available which, for technical, metallurgical and economic reasons, permits an extremely flexible method of desulphurisation.

The following Examples are given for the purpose of illustrating the present invention, with reference to the accompanying drawings, in which:

FIG. 1 shows a diagram in which is shown the change of the composition of a mixture of 55 weight-% of calciumcarbide and 45 weight-% of magnesium whoes grain size and specific weight are adapted to each other after aeration in a silo (+). At the removal of the mixture magnesium contents beween 46.4 and 42.3 weight-% magnesium were found, which corresponds to a spread of 4.1 weight-% of magnesium. A similar but coated mixture consisting of 45 weight-% of calcium-carbide, 45 weight-% of magnesium and 10 weight-% of coating (□) showed after the aeration and removal magnesium contents beween 46.2 and 44.6 weight-% of mangesium, corresponding to a spread of 1.6 weight-% of magnesium.

Figure 2:
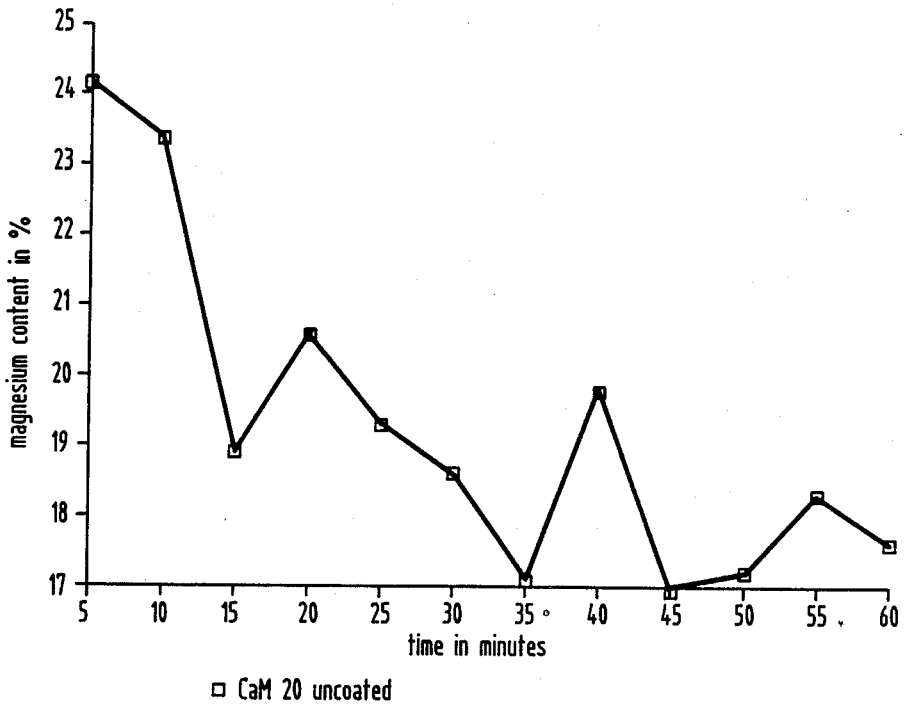

FIG. 2 In this case the mixture consisted of a mixture of 20 weight-% of magnesium of a grain size of 0.3 to 1 mm and fine grind calcium carbide of a grain size <0.1 mm (see example 8). The diagram shows the separation of the magnesium during aeration and subsequent removal which led to magnesium contents between 24.2 and 17.0 weight-% magnesium; this corresponds to a spread of 7.2 weight-% magnesium.

Figure 3:
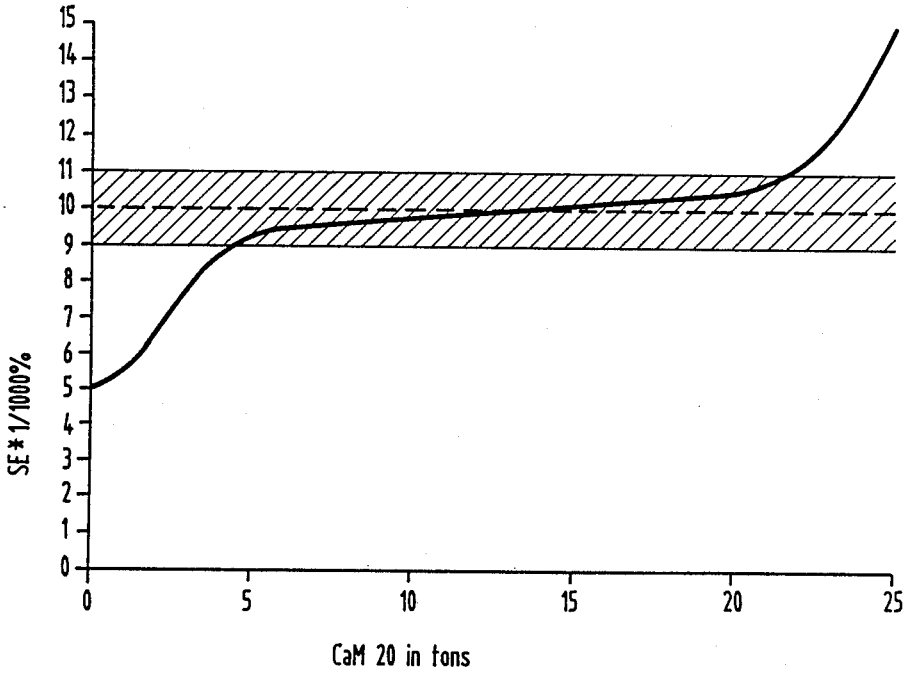

FIG. 3 shows a diagram in which the change of the degree of desulphurisation is shown for a mixture according to prior art (continuous line). Moreover the spread of the final sulfur content $S_E$. 1/1000 % is indicated for a mixture according to this invention (hatched aerea). In each case the same composition and the same quantity were injected into the iron melt.

With the prior art mixture the desulphurisation effect in the beginning was greater than at the end because the mixture then contains less magnesium due to the layering effect which has taken place in the silo. Using the mixture of the invention the desulphurisation effect remains constant within a relatively narrow range.

The desulphurisation of the iron melt (IM) took place in a charge ladle which contained 230 tons of iron with a temperature of 1350° C. The particular mixture used for the desulphurisation was blown in pneumatically by means of argon through an immersion lance.

Example 1 is a comparative example with a commercially available mixture for desulphurisation (Mg 50=50% by weight of magnesium metal+50% by weight of ball mill dust (aluminum oxide).

Examples 2 and 3 were carried out with the agent according to the present invention CaM 45 of the preferred composition. CaM 45 consists of 45% by weight technical calcium carbide, 45% by weight magnesium metal, 9.5% by weight furnace filter dust from the production of FeSi and 0.5% by weight of silicone oil. The co-injection experiments 4 and 5 took place with CaM 45, together with CaD C5 (95% by weight technical calcium carbide+5% by weight gas coal). Example 6 illustrates the co-injection of an agent CaM 25 which has the composition:

25% by weight magnesium metal, 65% by weight technical calcium carbide, 9.5% by weight furnace filter dust from the production of CaSi and 0.5% by weight silicone oil, together with CaD C5.

Abbreviations:

$E$ = degree of desulphurisation of the iron melts (*IM*)

$S_A$ = sulphur content (% by weight · $10^{-3}$) in the *IM* before the treatment $S_E$ = sulphur content (% by weight · $10^{-3}$) in the *IM* after the treatment $\Delta S = S_A - S_E$ $E\,\% = \frac{\Delta S}{S_A} \times 100$ The results obtained are set out in the following Table:

| Example No. | mixture for the desulphurisation | Mg 50 kg. | agent kg. | % Mg in the mixture for the desulphurisation | rate of blowing in | treatment time | $S_A$, | $S_E$ | E % |
|---|---|---|---|---|---|---|---|---|---|
| 1 | Mg 50 | 435 | — | 50 | 15 kg/min | 29 min | 40 | 5 | 87.5 |
| 2 | CaM 45 | — | 375 | 45 | 25 kg/min | 15 min | 50 | 5 | 90.0 |
| 3 | CaM 45 | — | 408 | 45 | 24 kg/min | 17 min | 42 | 2 | 95.2 |
| 4 | CaM 45 | — | 180 | 9.5 | 15 kg/min | 12 min | 46 | 2 | 95.6 |
| | CaD C5 | — | 672 | | 42 kg/min | 16 min | | | |
| 5 | CaM 45 | — | 98 | 9.4 | 14 kg/min | 7 min | 44 | 5 | 88.6 |
| | CaD C5 | — | 369 | | 41 kg/min | 9 min | | | |
| 6 | CaM 25 | — | 330 | 9.7 | 30 kg/min | 11 min | 47 | 3 | 93.6 |
| | | | 520 | | 40 kg/min | 13 min | | | |

Example 7.

A silo with 25 to 30 tons of mixture 1, 2 and 3 was, in each case, impinged against for a total of 10×3 minutes via a loosening device with 10 m³ gas/minute. Between the individual loosening steps there was introduced a pause of 5 minutes in order that the mixture could again settle. The total loosening treatment lasted 80 minutes. Thereafter, the mixture was removed and tested. The removal time lasted about 60 minutes for 25 tons, a 6 kg. sample being taken every 5 minutes (10 to 12 samples). The removal time for the 6 kg. of material amounted to about 20 seconds. These 6 kg. were reduced with a standardised sample divider to an amount sufficient for the analysis of the magnesium content.

TABLE

| desulphurisation mixture | Mg content wt. % | $CaC_2$ content wt. % | granulation (mm.) |
|---|---|---|---|
| 1 CaM 45 coated | 45 | 50 | 0.3–1 |
| 2 CaM 45 uncoated | 45 | 55 | 0.3–1 |
| 3 CaM 20 uncoated | 20 | 75 | Mg 0.3–1<br>$CaC_2$ <0.1 |

(CaM 45 = mixture with 45% magnesium content, CaM 20 = mixture with 20% magnesium content).

The results obtained are shown in FIG. 1 of the accompanying drawings.

The coated mixture (CaM 45 coated) practically does not separate and the uncoated mixture (CaM 45 uncoated) merely undergoes a slight separation which, in its order of magnitude, has hitherto not been achieved.

Example 8 (comparison).

A desulphurisation agent according to the prior art was investigated in which the granulation of the magnesium was from 0.3 to 1 mm. and that of the calcium carbide was <0.1 mm. In the case of this mixture, the loosening caused a distinct layering effect in which the magnesium and calcium carbide components separated from one another, which can clearly be seen from FIG. 2 of the accompanying drawings. Initially, the magnesium content was about 24% by weight and ends at about 17% by weight. These differences in the mixture lead to problems in the case of the desulphurisation treatment since the composition of the mixture and thus its effectiveness change in the course of the treatment.

Desulphurising with a mixture containing 20% by weight of magnesium with different magnesium and calcium carbide granulation (mixture 3 according to the above Table).

This mixture 3 was used for the desulphurisation and FIG. 3 of the accompanying drawings shows the differing sulphur end values ($S_E$ values) which adjust in the case of the desulphurisation treatment in a 25 tonne mixture supply. It can be seen that, in agreement with the layering effect to be deduced from FIG. 2 of the accompanying drawings, at the beginning of the removal of the mixture from the silo, substantially lower $S_E$ values are achieved than with the remaining amount of the mixture still present in the silo.

In the case of the use of the mixture with its constant magnesium content according to the present invention, the $S_E$ values differ only unsubstantially from the value aimed for the range indicated in FIG. 3.

We claim:

1. A composition for desulfurizing an iron melt, said composition consisting essentially of a mixture of discrete coated particles of calcium carbide and of a metallic element, where the ranges of the bulk densities and grain sizes of said particles in said mixture are substantially the same.

2. The method of preparing a composition consisting essentially of a mixture of discrete coated particles of calcium carbide and of a metal, which comprises grinding calcium carbide and a metal to substantially the same particle size, mixing the calcium carbide particles with the metal particles, and coating the mixed calcium carbide and metal particles first with an oily adhesive and subsequently with a finely divided inert material.

3. The method of desulfurizing an iron melt, which comprises introducing into said iron melt a composition consisting essentially of a mixture of discrete coated particles of calcium carbide and of a metal, where the bulk densities and grain sizes of said particles in said mixture are substantially the same, at a rate of 10 to 100 kg per minute, optionally together with another sulfurizing composition.

4. A composition of claim 1, wherein the metallic element is magnesium.

5. A composition of claim 1, which contains 10 to 90% by weight of magnesium and 90 to 10% by weight of calcium carbide.

6. A composition of claim 1, wherein the bulk density of the particles is in the range of from 0.7 to 1.0 g./cm$^3$.

7. A composition of claim 1, wherein the grain size of the particles is in the range of from 0.1 to 3 mm.

8. A composition of claim 7, wherein the grain size of the particles is in the range of from 0.3 to 1 mm.

9. A composition of claim 1, wherein the particles are coated with an adhesive and a finely divided dust.

10. A composition of claim 9, wherein the coating amounts to 1 to 10% by weight, based on the weight of the coated particles.

11. A composition of claim 9, wherein the adhesive is an oily liquid.

12. A composition of claim 11, wherein the oily liquid is a vegetable oil, a silicone oil, a mineral oil, or a mixture of two or more of these.

13. A composition of claim 9, wherein the coating contains finely divided silicic acid, bentonite, furnace filter dust from the production of calcium-silicon, ferrosilicon or other ferrous alloys or other oxidic compounds.

14. Process for the preparation of a composition of claim 9, wherein calcium carbide and the metallic component are ground to the necessary particle size, mixed under an inert gas atmosphere and subsequently coated with an oily adhesive and with a finely divided material.

* * * * *